United States Patent [19]

Kiyooka

[11] Patent Number: 4,517,939

[45] Date of Patent: May 21, 1985

[54] DUST COLLECTING DEVICE

[75] Inventor: Katsumi Kiyooka, Warabi, Japan

[73] Assignee: Komatsu Zenoah Co., Tokyo, Japan

[21] Appl. No.: 389,552

[22] Filed: Jun. 17, 1982

[30] Foreign Application Priority Data

| | | | |
|---|---|---|---|
| Jun. 19, 1981 | [JP] | Japan | 56-89470[U] |
| Jul. 3, 1981 | [JP] | Japan | 56-98600[U] |
| Jul. 3, 1981 | [JP] | Japan | 56-98601[U] |
| Aug. 14, 1981 | [JP] | Japan | 56-120047[U] |

[51] Int. Cl.[3] ..... F02B 63/02

[52] U.S. Cl. ..... 123/198 E; 123/179 SE; 123/2

[58] Field of Search ..... 123/2, 195 C, 198 E, 123/179 SE; 15/405, 412, 413; 415/219 C; 206/335; 150/52 K; 181/204

[56] References Cited

U.S. PATENT DOCUMENTS

| | | | |
|---|---|---|---|
| 2,815,742 | 12/1957 | Kiekhaefer | 123/198 E |
| 2,839,042 | 6/1958 | Armstrong et al. | 123/198 E |
| 3,036,566 | 5/1962 | Dobbertin | 123/198 E |
| 4,013,105 | 3/1977 | Uuskallio | 123/198 E |
| 4,233,043 | 11/1980 | Catterson | 123/198 E |
| 4,269,571 | 5/1981 | Shikutani et al. | 15/405 |
| 4,350,123 | 9/1982 | Kossek et al. | 123/2 |
| 4,370,809 | 2/1983 | Takahashi et al. | 123/179 SE |
| 4,404,706 | 9/1983 | Loyd | 417/234 |

*Primary Examiner*—E. Rollins Cross

*Attorney, Agent, or Firm*—Jones & Askew

[57] ABSTRACT

A compact engine and blower contained in a portable casing. The engine fuel tank, its inlet port and the closure for the inlet port all are located within the casing, which has a cover openable, for access to the fuel inlet port. The casing cover can be latched closed only when the fuel inlet closure is properly placed on the inlet port.

4 Claims, 9 Drawing Figures

DUST COLLECTING DEVICE

FIELD OF THE INVENTION

This invention relates to a portable blower or a portable engine for collection of fallen leaves and others to clean and more particularly to a structure of a casing body including a recoil starter, an ignition confirmation apparatus and a stop warning apparatus.

BACKGROUND OF THE INVENTION

Heretofore, in the portable engine, a cover of a casing for containing the engine is fixed to the casing with a screw and an inlet of a fuel tank contained in the casing is provided outside upper portion of the casing passing through the casing. Arrangement is such that, in use, it is inconvenient for the operator to fix or remove the cover of the casing further, it tend to soil the operator's clothes and others because the fuel is often spilt over the surface of the casing adjacent the inlet of the fuel.

Further, in a recoil starter of the engine of this type, a reel is rotatably supported by a supporting member fixed to the casing. In order to prevent removal of the reel from the supporting member, a snap ring is provided to engage an end portion of the supporting member and/or there is provided a bolt screw connected to the end portion of the supporting member to prevent removal of the reel through a washer from the supporting member. In either case, the structure is rather complicated and time consumable. Further in the engine of this type, an ignition plug must be removed to confirm if the secondary circuit is properly applied with current when the engine does not start to operate in spite of the ignition action is taken.

Further, the engine of this type has such defect in which the fuel is excessively absorbed and consequently the ignition can not be carried out satisfactorily when the engine is started to operate through the recoil starter with the switch is erroneously connected.

SUMMARY OF THE INVENTION

An object of this investion is to provide a dust collecting device in which the cover is openably provided the casing body. The inlet of the fuel tank is covered with the cover and arranged such that the opening of the fuel tank is easy and prevent the fuel to be spilt and from soil the operator's clothes.

Another object of this invention is to provide an improved recoil starter with which the engine is started by strongly pulling a string which is wound around the reel.

Further another object of this invention is to provide an ignition confirmation apparatus in which the application of the current to the secondary circuit of the ignition coil is confirmed at the start of the engine by a warning apparatus.

Still another object of this invention is to provide a stop warning apparatus in which a stop switch and the warning apparatus are connected in series to the circuit which is connected in parallel to a point so that the stop switch is cut off by the warning apparatus such as lamp and/or buzzer when the engine is started with the stop switch is erroneously connected.

Other and further objects and advantages of the present invention will be apparent from the following description and accompanying drawings which, by way of illustration, show a preferred embodiment of the present invention and the principle thereof.

DETAILED DESCRIPTION OF THIS INVENTION

Figure 1:
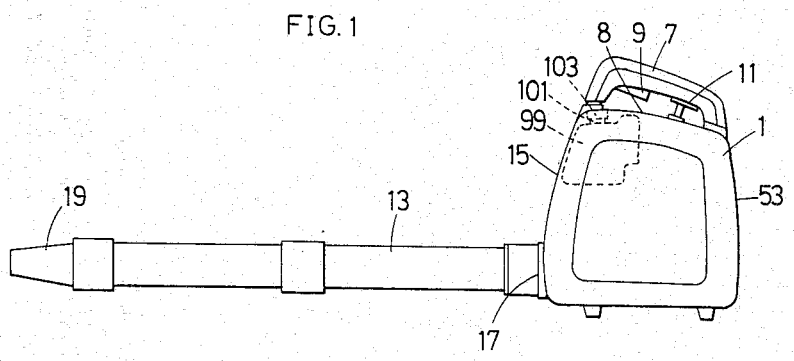
FIG. 1 is a side view of one embodiment of this invention.
Figure 2:
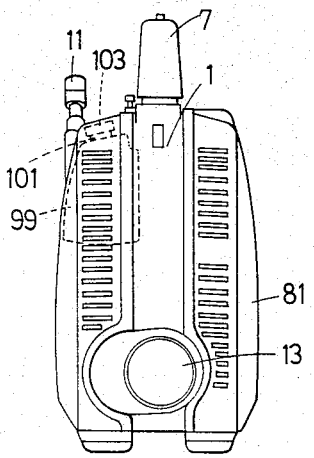
FIG. 2 is a front view of essential portion of the above, FIGS. 3, 4 and 5 respectively show spectional side elevation, sectional rear elevation, and sectional plan view.
Figure 3:
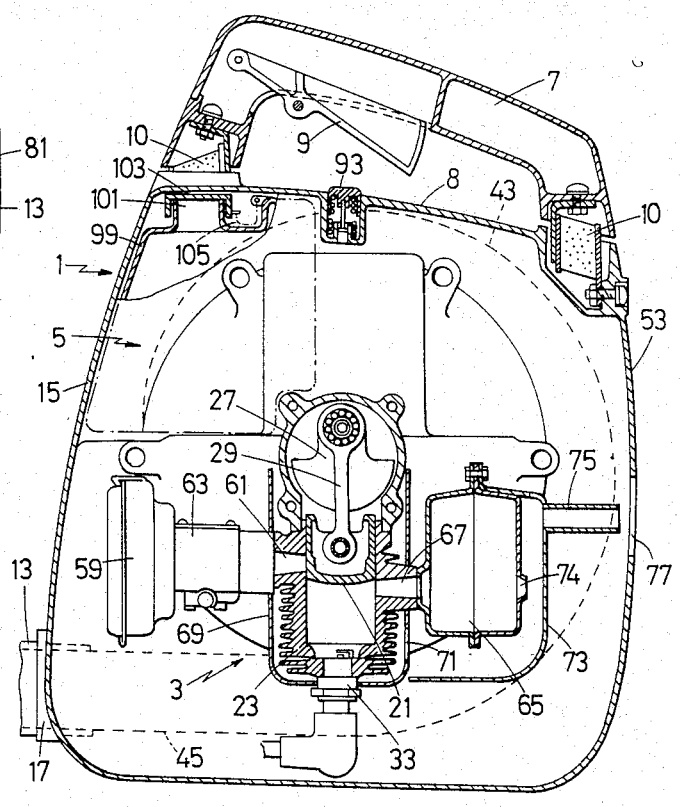
Figure 4:
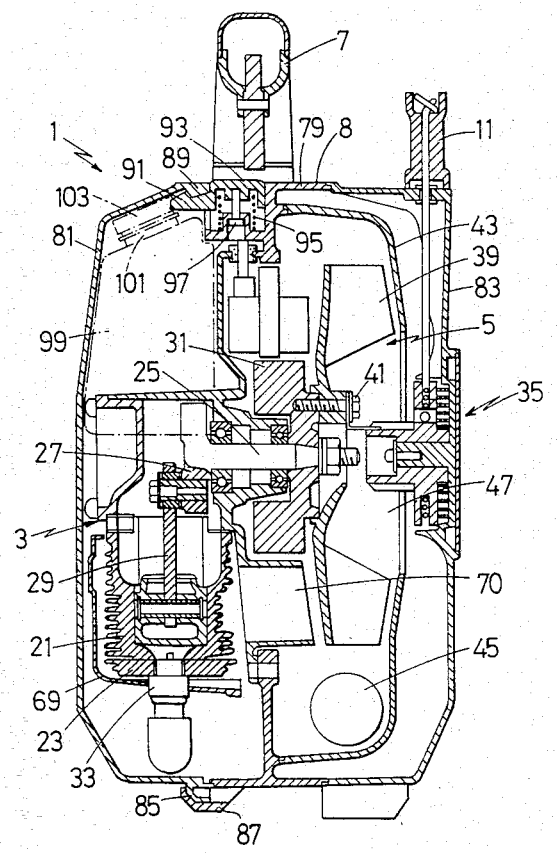
Figure 5:
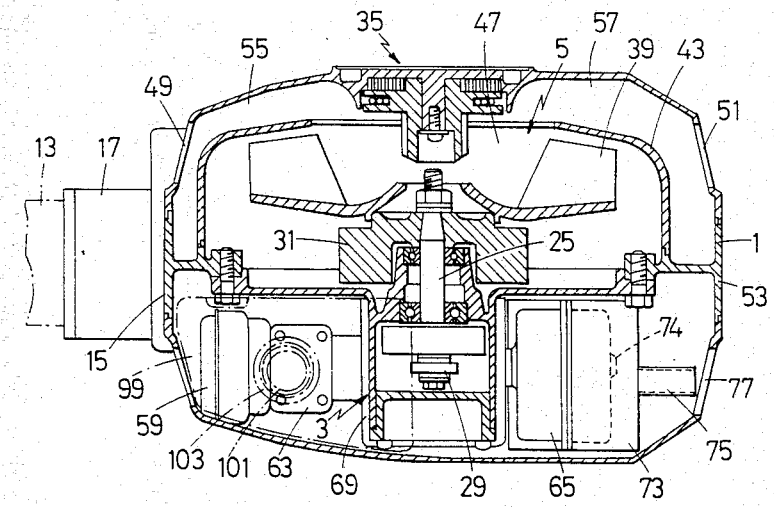

Referring to the attached drawing, a detailed description of the portable engine, one embodiment of this invention is given as follows.

In the drawing, numeral 1 a casing for containing an engine 3 and a blower 5, and numeral 7 a handle which is fixed to an upper portion 8 of the casing 1, numeral 9 an acceleration bar, numeral 11 a starter handle. Numeral 13 is a blast pipe engaged at one end with an exhaust port 17 formed on the front portion 15 of the casing 1 and provided with a nozzle 19 at its another end. Numeral 21 is a piston slidably mounted within a cylinder 23 of the engine 3, numeral 25 is a crank shaft provided at one end with a crank arm 27 which is linked with the piston 21 by a linking stick 29. Numeral 31 is a flywheel fixed to the other end of the crank shaft 25, numeral 33 is an ignition plug, and numeral 35 is a recoil starter.

The blower 5 is arranged such described as follow. Numeral 39 is a fan fixed to the flywheel 31 by means of a bolt 41, numeral 43 is a fan case which surrounds the fan 39 and communicates through a blast path 45 with the exhaust port 17 which is formed on the front portion 15 of the casing 1. Numeral 47 is an absorption section provided at the central portion of the fan case 43, numerals 49 and 51 are air absorption ports formed on the front 15 and rear portion 53 of the casing 1 and communicate with the air absorption section 47 through air absorption paths 55 and 57. Numeral 59 is an air cleaner fixed to a carburetor 63 which communicates with an air absorption port 61 of the engine 3, numeral 65 is a muffler which communicates with an exhaust port 67 of the engine 3, numeral 69 is a cylinder cover to cover the cylinder 23 and guides the air from a communication port 70 which communicates with a high pressure section of the blower 5 to an exhaust port 71 to exhaust the air. Numeral 73 is a muffler cover for covering the muffler 65 and guides the air which is exhausted from the exhaust port 71 and mix with the air which is exhausted from the exhaust port 74 and finally exhausted from an exhaust pipe 75 passing through an exhaust port 77. The casing 1 is arranged such that the casing body 79 and the cover 81 provided on one side of the casing body 79 are separable each other. There is provided a fan cover 83 on the other side of the casing body 79. The fan cover 83 is detachably mounted to the casing body 79 by means of a screw (not shown). A detent 85 formed on a lower end portion of the cover 81 detachably engage with an another detent 87 provided on the casing body 79. Numeral 89 is a stopper to define the upper most position of a detent 93 which is fixed to a press member 93 and provided descendably on the cover 81. Numeral 99 is a fuel tank contained within the casing 1, numeral 101 is an inlet port of the fuel tank 99 and is detachably engages with an inlet cover 103. Numeral 105 is a chain for connecting the cover 103 with the fuel tank 99.

The arrangement is such that the cover 81 can be engaged with the casing body 79 only when the inlet cover 103 is mounted on the inlet port 101 and then, the cover 81 blocks the inlet port 101.

With the arrangement disclosed herein, the operator holds the handle 7 and the blast pipe 13 to collect the fallen leaves, dust and others on the ground by ejection of the air from the nozzle 19 with the help of the fan 39 driven by the engine 3.

In order to supply the fuel to the fuel tank 99, the press member 93 is pressed down hard against elasticity of the spring 95 until such time when the detent 91 moves downward to remove from the other detent 89. Then, the upper portion of the cover 81 is released from the casing body 79. Further, the stopper 85 at the lower portion of the cover 81 is removed from the detent 87 to separate the cover 81 from the casing body 79. The inlet cover 103 is removed to supply the fuel through the inlet port 101. Even if the fuel over flowed, the fuel does not contact to the surface of the cover 81 and the casing body 79. When supply action is over, the inlet cover 103 is screw connected to the inlet port 101 and the cover 81 is mounted to the casing body 79. At this time, the detent 85 is engaged with the other detent 87 and the upper portion of the cover 81 must be pressed from its side toward the casing body 79. The other detent 89 advance down ward against elasticity of the spring 95 to engage with the detent 91.

With the arrangement disclosed herein, the supply operation is simplified and the fuel does not attach to the surface of the casing and consequently does not soil the operator's clothes. In the above disclosed embodiment, the cover 81 is detachably mounted to the casing body 79. However in the modified embodiment, the cover 81 is pivotally mounted to the casing body 79.

Figure 6:
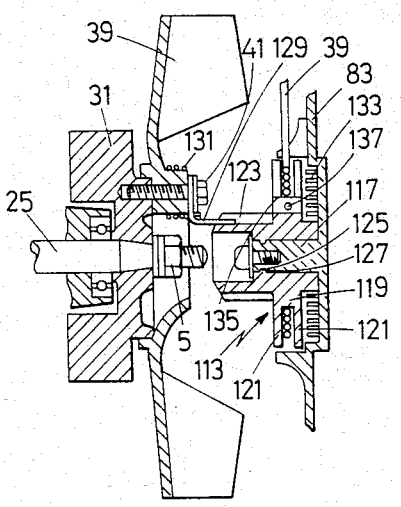
FIGS. 6 and 7 show modification of the embodiment of this invention.
Figure 7:
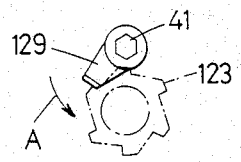

FIGS. 6 and 7 show detail of the recoil starter of the second embodiment. Numeral 13 is a reel rotatably supported on a support member 117 integrally connected to a fan cover 83 made of synthetic resin and cover a cooling fan 39. The reel is formed from a synthetic resin which has a required elasticity and provided with flanges 121, 121 at both end of the body portion 119 thereof. Further, at end portion of the flange, there is provided a ratchet 123. Numeral 125 is a circular groove formed circumuferentially on the portion of outer diameter of the support member 117 and 127 is a circular projection formed circumferentially on the portion adjacent inside diameter of the reel 113 and detachably engages with the circular groove 125. The circular projection 127 smoothly engages with the circular groove 125 by pressing the reel 113 against the support member 117 to engage therewith. Numeral 129 is a detent rotatably engages with a body portion of a bolt 119 and engages with a ratchet 123 when moved by a spring 131 toward a direction indicated by an arrow in FIG. 9. With the centrifugal force generated by rotation of the rotation shaft 25, the detent is released from the ratchet 123 by turning to reverse direction of the arrow against the elasticity of the spring 131. Numeral 131 is a spiral spring to engage with the reel 113 for rotation in a desired direction. Numeral 135 is a circular hole which axially pass through the flanges 121, 121. Numeral 137 engages with the hole 135. A string 139 is connected at one hand to the starter handle (not shown) and is rolled up within the body 119 by the spiral spring 133.

In order to start the engine, the string 139 is pulled heavily through the starter handle (not shown) and the reel 113 ignite against the elasticity of the spiral spring 133. The detent 129 is released from engagement with the ratchet 123 and rotares the rotation shaft 25 through flywheel 31 to start the engine. When the engine is started, rotation of the shaft 25 separates the detent 129 from ratchet 123 by centrifugal force. When the engine is stopped, the detent 129 comes into engagement with the ratchet 123 by means of the spring 131.

In order to combine the reel with the support member 117, the reel 113 is engaged with the support member 117 and compress the reel axially until the circular groove 125 engages with the circular projection 127.

The arrangement is such that, the structure is simple and such specific tool as snap ring and screws are not required. Therefore, the device is manufactured at low cost.

There is given a detailed description relating to the third example of this invention hereinafter.

Figure 8:
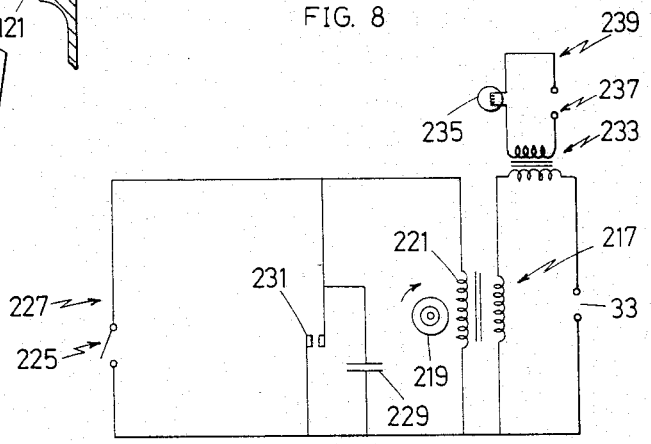
FIG. 8 shows another modification of this invention.

In the drawing, FIG. 8 shows a circuit diagram of a small sized two cycle engine for use in a mowing machine, chain saw and others. Numeral 217 is an ignition coil energized responding to the flywheel magnet 219 fixed to one end of the crank shaft 25. In the ignition coil 217, primary voltage is generated in the primary coil 221 by the rotation of the flywheel magnet. Responsing to the above, the high voltage current flows through the secondary coil 213 to make a spark discharge at the ignition plug 115.

Numeral 225 is a switch in the form of a push button and connected to both ends of the primary coil 221 to form a circuit 227. Numeral 229 is a condenser, 231 is a point cooperates with the engine to perform switching action. Numeral 233 is an induction coil which response and excited when a high voltage induced current flows through the secondary coil 223 and both ends are connected to a warning circuit 239 which is formed from a warning apparatus 235 and switch 237.

In the example disclosed herein above, the engine is started by taking steps given as follow.

The crank shaft 25 is rotated by an operation of a recoil starter (not shown) with the condition in which the switch 225 is kept off. The flywheel magnet rotates and the primary voltage is generated on the primary coil of the ignition coil 217. Then, the point 231 starts switching action. Within a predetermined time period required for spark ignition of the engine, the voltage on the primary coil 223 is amplified and the point 231 is switched off. At this moment, responsing to the sudden change of current on the secondary coil 221, there is generated a high voltage current on the secondary coil 223 to make the ignition plug discharge. Thus, the engine is started.

It is confirmed that the induction coil 233 is induced and discharged by the high voltage current to ignite the warning apparatus 235 of the warning circuit 239 and the ignition plug is ignited.

Figure 9:
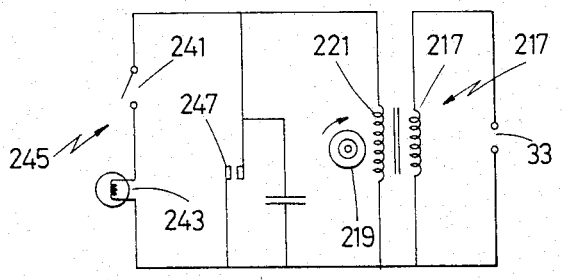
FIG. 9 shows still another modification of this invention.

With respect to the stop warning apparatus of a modified example shown in FIG. 9, there is given only those which differ from those of the example shown in FIG. 8. Numeral 241 is a toggle switch which does not timely return and forms a circuit 245, connected to both ends of the primary coil connected in series. Numeral 229 is a condenser, numeral 247 is a point which cooperates with the crank shaft for switching.

In the example disclosed herein above, the engine is started by taking steps given as follow.

The stop switch is kept off. The crank shaft 25 is rotated by the operation of the recoil starter (not shown). At this time, the flywheel magnet 219 rotates. When the primary voltage is generated on the primary coil 221 of the ignition coil, the point 247 of the primary coil 221 starts switching action. In a predetermined time period necessary for ignition of the engine, the voltage on the primary coil 221 is increased and the point 247 is switched off. At this moment, a high voltage current is generated by being induced by the sudden change of the current, in the secondary coil 227 to make the ignition plug 33 discharge. Thus, the engine is started.

In order to stop the engine, the stop switch 241 is turned on to connect the primary coil and the high voltage current stop to flow through the secondary coil 227 and consequently, the ignition plug 33 stop to ignition to stop the engine.

In case to restart the engine by taking steps given above, if the recoil starter (not shown) is operated without turning off the stop switch 241, the warning apparatus 243 is lit up to indicate that the primary coil 221 is in a connected condition. Therefore, the arrangement prevents the trouble caused by failure of switching off the stop switch 241.

It is understood that this invention is not limited within a scope disclosed in examples given herein, but can be embodied in other manners without deviation from the spirit of this invention.

Although a preferred form of the present invention has been illustrated and described, it should be understood that the device is capable of modification by one skilled in the art without departing from the principles of the invention. Accordingly, the scope of the invention is to be limited only by the claim appended hereto.

What is claimed is:

1. The improvement in a portable internal combustion engine, comprising:

a casing containing at least part of the engine, said casing comprising a body and a cover closably and openably connected to the body;

an engine fuel tank located within said casing;

said fuel tank having an inlet port for admitting fuel to the fuel tank, and a closure detachably positioned to close the inlet port;

said inlet port and said closure being concealed by said cover except when the cover is opened; and latch means associated with said cover and responsive to the position of said closure on the inlet port to releasably retain the cover in closed position only when the closure is blocking said inlet port, whereby the cover cannot be retained closed while the closure is detached from the inlet port.

2. Apparatus as in claim 1, wherein:

said latch means comprises a first latching surface associated with said cover;

a latch engaging member having a second latching surface associated with said casing and selectably engaged by said first latching surface to retain the cover closed as the cover is moved to the closed position;

means movably mounting said latch engaging member in spaced relation to said inlet port so that the latch engaging member is moved toward the inlet port blocking position of said closure in response to said engagement by the first latching surface, as the cover is moved to the closed position;

said latch engaging member having a closure engaging surface which contacts the closure in position blocking the inlet port and there holds the latch engaging member in a first position for said latching engagement by said first and second latch engaging surfaces;

said movable mounting means permitting the latch engaging member to move beyond said first position to a second position if the closure is not in position for blocking the inlet port and for contact by said closure engaging surface at the first position; and said latch engaging member in said second position being inoperative for said latching engagement, so that the cover can be latched to the closed position only when the closure is in position blocking the inlet port of the fuel tank.

3. Apparatus as in claim 2, wherein:

said closure engaging surface of the latch engaging member forms a fulcrum about which the latch engaging member moves for said latching engagement when contacting said closure at said first position.

4. Apparatus as in claim 3, further comprising:

a release member manually operable to move said latch engaging member about the fulcrum when at the first position, so as to unlatch said latching engagement and permit opening said cover; and resilient means operative to bias said release member in opposition to said manual operation, so that the latch engaging member can keep the cover latched in the closed position in the absence of said manual engagement.

* * * * *